United States Patent [19]

Madsen

[11] Patent Number: 4,563,769

[45] Date of Patent: Jan. 7, 1986

[54] X-RAY GENERATOR DEVICE

[75] Inventor: Jens U. Madsen, Farum, Denmark

[73] Assignee: Andrex Radiation Products A/S, Denmark

[21] Appl. No.: 452,013

[22] Filed: Dec. 21, 1982

[30] Foreign Application Priority Data

Dec. 29, 1981 [DK] Denmark ..... 5816/81

[51] Int. Cl.[4] ..... H01J 35/04

[52] U.S. Cl. ..... 378/121; 378/125; 378/135; 378/143; 378/205; 313/255; 313/288; 313/146

[58] Field of Search ..... 378/121, 143–145, 378/122, 125, 126, 131–133, 135, 137, 205; 313/146, 288, 255, 237; 250/491.1

[56] References Cited

U.S. PATENT DOCUMENTS

| | | | |
|---|---|---|---|
| 2,298,335 | 10/1942 | Atlee | 378/125 |
| 2,946,892 | 7/1960 | Bas-Taymaz | 378/137 |
| 2,958,799 | 11/1960 | Mihailovic | 378/135 |
| 3,303,372 | 2/1967 | Gager | 378/122 |
| 3,714,487 | 1/1973 | Jacob | 378/135 |
| 4,104,531 | 8/1978 | Weiss | 378/121 |
| 4,159,436 | 6/1979 | Ely | 378/135 |

FOREIGN PATENT DOCUMENTS

| | | |
|---|---|---|
| 2720640 | 9/1981 | Fed. Rep. of Germany . |
| 944917 | 9/1952 | France . |
| 868830 | 5/1961 | United Kingdom . |
| 1057284 | 2/1967 | United Kingdom . |
| 2023979 | 1/1980 | United Kingdom . |

*Primary Examiner*—Craig E. Church
*Assistant Examiner*—Charles F. Wieland
*Attorney, Agent, or Firm*—Robert J. Koch

[57] ABSTRACT

In an X-ray generator device a target member emitting X-rays by electron bombardment is arranged in a rod-shaped tubular probe and is provided with a conically tapering front part facing a comparatively narrow aperture in a controlling electron beam diaphragm for the purpose of forming a substantially punctiform radiation source. The position of the target member is adjusted by securing the rod-shaped target member at a part of its length reckoned from its opposite, rearmost end in a central bore of an oblong cylindrical target carrier positioned coaxially in the probe, said target carrier being only at its foremost end connected with the wall of the probe, thereby allowing fine adjustment of the target member with respect to said aperture by displacement of said opposite end of the target carrier in a radial plane in the probe, e.g. by means of wedge means formed as adjusting screws in the annular channel between the target carrier and the inner wall of the probe.

4 Claims, 4 Drawing Figures

X-RAY GENERATOR DEVICE

BACKGROUND OF THE INVENTION

This invention relates to X-ray generator devices and, in particular, to an X-ray generator device comprising a radiation source in the form of a conically tapering front part of a target member to provide X-ray emission with a nearly uniform distribution in a radial plane through the tip of the target member.

Such X-ray generator devices find particular use in certain forms of industrial X-ray examination, in which respect small physical dimensions of the X-ray emitting portion of the generator device are desired as a consequence of the particular character of the object to be examined, for instance when controlling welding. Moreover, a dental X-ray device having a similar design of the X-ray generator device is known from British Patent Specification No. 868,830.

X-ray generators of this type generally include a beam focussing and deflecting system which is directed toward controlling the electron beam emitted from the electron gun as precisely as possible in order to hit the tip of the tapering front part of the target member, thereby providing X-ray emission with a uniform distribution in a radial plane through the point of the cone. Particularly, but not exclusively, as regards X-ray examination of the kind in which the radiation-sensitive detecting member, for instance film, is positioned at a distance from the object to be examined, it is at the same time essential that the physical dimensions of the X-ray source formed by the target member are as small as to appear substantially punctiform. Otherwise, the image formed on the detecting member will actually show a certain blurred contour determined by the physical dimensions of the radiation source and the ratios of distances of the objects from the radiation source and the detecting member, respectively, that will make it difficult to obtain a satisfactory X-ray image.

It is an object of the present invention to provide an X-ray generator device of the above mentioned kind, in which the requirement of hitting the tip of the conical target member as accurately as possible to allow uniform distribution of the radiation in a radial plane is fulfilled by an electron beam having a very small cross-section so that the spatial extent of the radiation source is confined to the top of the target member. It is a further object of the invention to allow the target member to be positioned in an X-ray emitting generator portion of very small physical dimensions which facilitate work on test objects such as pipe welding which make access difficult.

SUMMARY OF THE INVENTION

According to the invention, an X-ray generator device is provided, comprising an electron gun, a focussing and deflecting system for controlling an electron beam emitted from the electron gun, a target member, emitting X-rays in response to electron bombardment by said electron beam, a tubular probe accommodating said target member in its interior in the proximity of a free end of the probe, said probe being shaped as a comparatively slender rod, said target member being provided with a conically tapering front part and being formed as a rod element, an electron beam diaphragm being positioned in the probe and electrically insulated from the target member and having a comparatively narrow aperture facing said front part of the target member, an oblong target carrier being located substantially coaxially in the probe and having a central bore to accommodate said target member at a part of its length reckoned from its opposite rearmost end, said target carrier being only at its foremost end closest to the front part of the target member connected with the wall of the tubular probe, and adjusting means being provided which are accessible from said free end of the probe and adapted to fine adjustment of the conically tapering front part of the target member with respect to the opposed aperture by displacement of the opposite rearmost end of the target carrier radially in the probe.

When positioned in said carrier the tip operating as point source at the front part of the target member can be exactly located in the electron beam directed through the aperture of the electron beam diaphragm during the manufacture of the X-ray generator device, provision having been made in connection with the adjustment of a simple electrical measurement of the electron current passing through the aperture of the electron beam diaphragm and reaching the target member, for causing the very narrow beam to exactly hit the conically tapering front part of the target member inspite of tolerances during manufacture. The probe in which the rod-shaped target member is positioned may be designed as a rod having small cross-sectional dimensions so as to be mounted even in relatively narrow tube ends.

BRIEF DESCRIPTION OF THE DRAWING

The invention will now be more fully explained with reference to the accompanying drawings, in which.

DESCRIPTION OF THE PREFERRED EMBODIMENT

Figure 1:
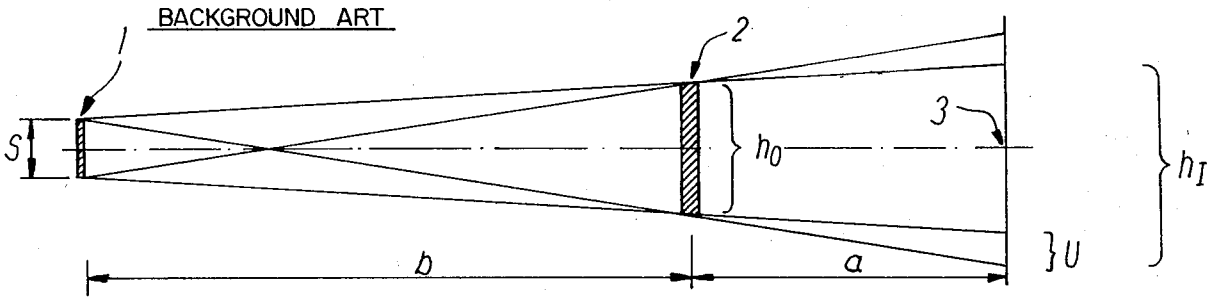
FIG. 1 illustrates X-ray image formation by means of a conventional target member.

In FIG. 1 X-rays are emitted from a radiation source 1 having a physical dimension S toward an object 2 having a height $h_O$ on the image plane. An X-ray detector 3, in the form of a plane film on which an image having a height $h_I$ is formed is located spaced from the object. Due to the physical dimension of the radiation source, blurred areas will occur in the image contours, having a width U determined by $$U/S=a/b,$$

wherein a is the distance from the object 2 to the film 3, and b is the distance from the radiation source 1 to the object 2.

Figure 2:
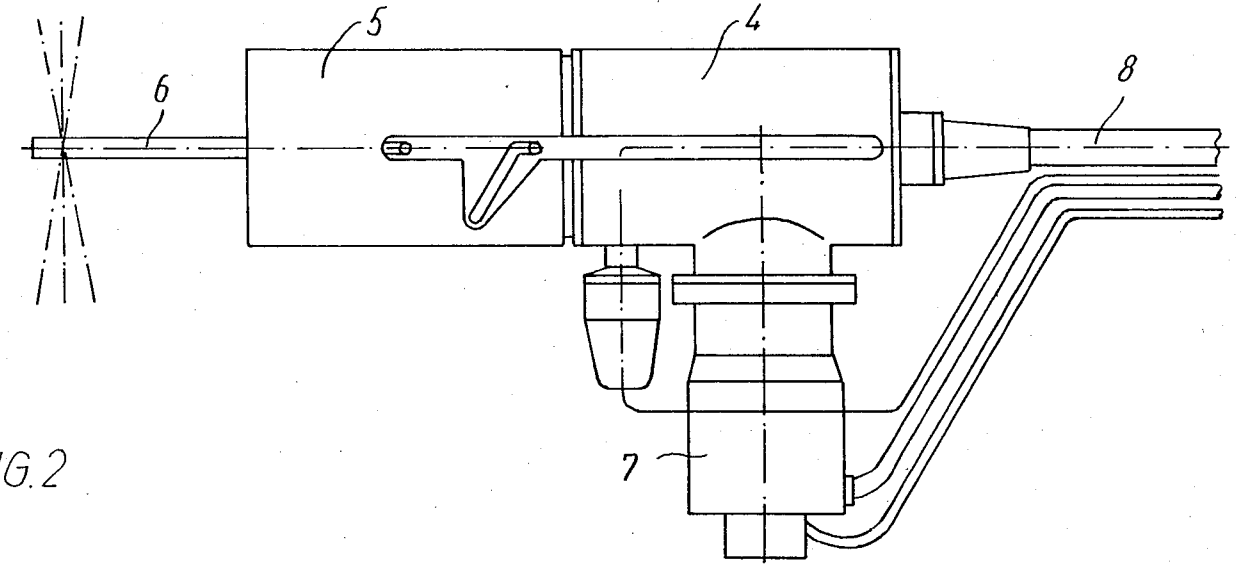
FIG. 2 is a schematical illustration of an embodiment of an X-ray generator device according to the invention.

The embodiment illustrated in FIG. 2 of an X-ray generator device according to the invention includes an electron gun 4, from which an electron beam is emitted through a hollow anode in a known manner. By means of a focussing and deflecting unit 5 which may include a magnetic lens system and deflection coils the electron beam emitted from the electron gun 4 is directed into a rod-shaped probe 6, in the proximity of the free end of which a target member emitting X-rays by electron bombardment is positioned, such as will be explained in the following. A high-vacuum pump 7 for maintaining a continuous vacuum during operation is connected with the X-ray generator device made up of the electron gun 4, the focussing and deflecting unit 5 and the rod-shaped probe 6, and the electron gun 4 is fed through a high-voltage cable 8.

Figure 3:
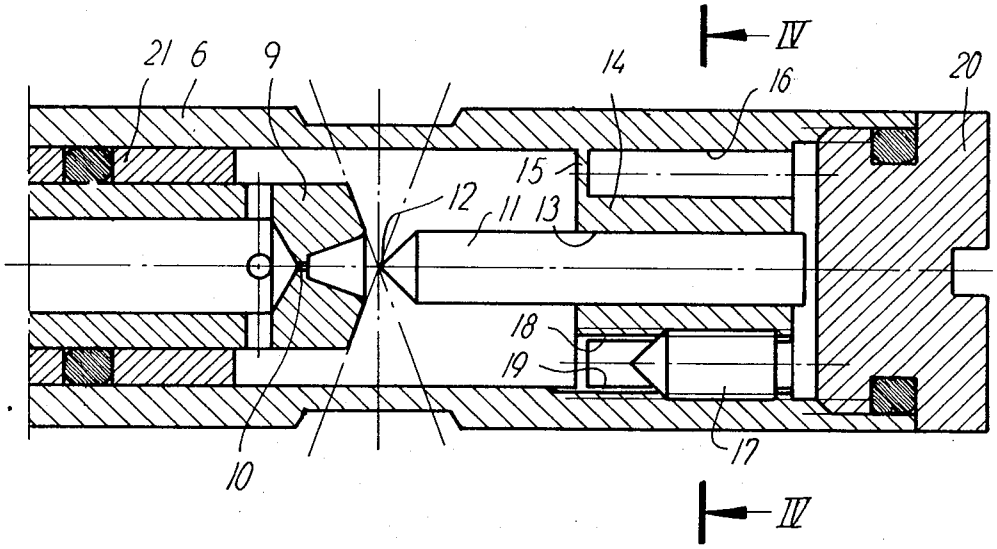
FIG. 3 is a longitudinal sectional view of a part of a radiation emitting probe of the X-ray generator device in FIG. 2.

As it appears in the longitudinal sectional view shown in FIG. 3, an electron beam diaphragm 9 is arranged as the outermost control member in the proximity of the free end of the rod-shaped probe 6, said diaphragm having a comparatively narrow aperture 10, for instance having a diameter of 200$\mu$. A rod having a conically tapering front part 12 positioned opposite the aperture 10 of the electron beam diaphragm 9 is arranged in the probe as the X-ray emitting target member 11. The rod, which may for instance be made from wolfram, and the part of the probe 6 in which it, are arranged is insulated from the remainder of the X-ray generator device including the electron beam diaphragm 9 by means of an insulator 21.

At a part of its length reckoned from its opposite rearmost end the target member 11 is secured in a central bore 13 of an oblong cylindrical target carrier 14, which is positioned substantially coaxially in the probe 6, but which is connected only at its foremost end closest to the front part of the target member 11 with the external surface of the probe 6 through a flange portion 15 of comparatively small thickness.

Figure 4:
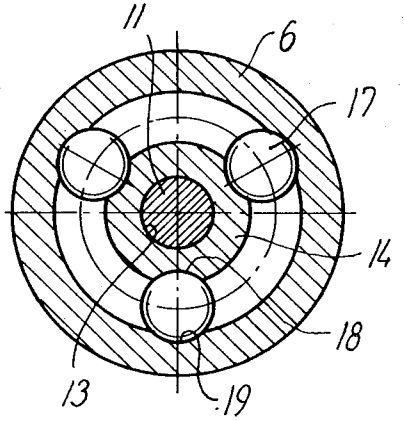
FIG. 4 is a cross-sectional view along the lines IV—IV in FIG. 3.

For fine adjustment of the location of the conically tapering front part 12 of the target member 11 with respect to the aperture 10 of the electron beam diaphragm 9, by displacement of the rearmost end of the target carrier 14 in a radial plane in the probe 6, the illustrated embodiment accommodates in the annular channel 16 defined by the cylindrical internal surface of the probe 6 a number of separate adjusting screws 17 arranged at equal angular spacing, as illustrated in FIG. 4. To receive the adjusting screws 17 the external surface of the target carrier 14 and the internal surface of the probe 6 are provided with opposed threaded axially directed depressions, 18 and 19, respectively. The adjusting screws 17 or the depressions 18 and 19 are lengthwise tapered so that the adjusting screws will operate as separate wedge means to locally adjust the distance between the target carrier 14 and the internal wall of the probe 6. The adjustment is carried out by means of a hand tool, for instance a screwdriver, from the free end of the probe 6 before closing it by a vacuumtight end plug 20.

The radial displacement of the rearmost end of the target carrier serving for adjustment of the front part of the target member may be carried out by other forms of adjusting means than those particularly shown in the drawings and described above as an embodiment of such means.

I claim:

1. An X-ray generator device comprising:

an electron gun having an apertured anode member;

a focusing and deflecting system for controlling an electron beam emitted from the electron gun;

a slender, elongate, tubular probe connected at one end with said focusing and deflecting system to receive said electron beam;

an electron beam diaphragm disposed in the interior of said probe in proximity to the other, free end thereof and having a comparatively narrow aperture;

a target member disposed in the interior of the free end of said probe with a conically tapering front part facing said diaphragm;

a target carrier positioned substantially coaxially in the probe and electrically insulated with respect to said diaphragm, and adapted to support said target member; and mechanical adjusting means provided in said probe and accessible from the exterior of the probe for fine alignment of the conically tapering front part of the target member and the opposed aperture of the diaphragm with respect to each other by displacement of either in any direction in a radial plane with respect to the axis of the probe.

2. An X-ray generator as claimed in claim 1, wherein the target carrier has a substantially cylindrical surface and is connected with the wall of the probe only at the front of said probe through a flange member having a comparatively small thickness, said adjusting means comprising a plurality of separate wedge means disposed in the annular channel defined by the external surface of the target carrier and the internal surface of the wall of the probe for local adjustment of the distance between the target carrier and the wall of the probe by operating from the free end of the probe.

3. An X-ray generator as claimed in claim 2, wherein said wedge means comprise a plurality of adjusting screws arranged with equal angular spacing in said annular channel, and a like number of threaded axially directed depressions provided in the external surface of the target carrier and the internal surface of the wall of the probe to receive said adjusting screws, said adjusting screws being lengthwise tapered.

4. An X-ray generator as claimed in claim 2, wherein said wedge means comprise a plurality of adjusting screws arranged with equal angular spacing in said annular channel, and a like number of threaded axially directed depressions provided in the external surface of the target carrier and the internal surface of the wall of the probe to receive said adjusting screws, said depressions being lengthwise tapered.

* * * * *